United States Patent [19]

Malkin

[11] Patent Number: 4,923,138

[45] Date of Patent: May 8, 1990

[54] TURNTABLE FOR MOTORIZED DELIVERY OF COILED STOCK

[75] Inventor: Bruce Malkin, Newtown, Conn.

[73] Assignee: Norwalk Innovation Lab, Inc., Milford, Conn.

[21] Appl. No.: 291,637

[22] Filed: Dec. 29, 1988

[51] Int. Cl.[5] ..... B21C 47/16; B65H 23/185

[52] U.S. Cl. ..... 242/78.6; 242/55; 242/105

[58] Field of Search ..... 242/78.6, 78.7, 78.8, 242/55, 105, 193; 72/183

[56] References Cited

U.S. PATENT DOCUMENTS

| | | | |
|---|---|---|---|
| 4,249,705 | 2/1981 | Brooks et al. | 242/78.6 |
| 4,290,561 | 9/1981 | Satzinger | 242/55 |
| 4,290,563 | 9/1981 | Brooks et al. | 242/78.6 |
| 4,582,271 | 4/1986 | Takahashi | 242/105 X |
| 4,610,408 | 9/1986 | Box et al. | 242/78.6 |
| 4,773,610 | 9/1988 | Nordlof | 242/78.6 |

*Primary Examiner*—Stuart S. Levy
*Assistant Examiner*—Steven M. DuBois
*Attorney, Agent, or Firm*—F. Eugene Davis, IV

[57] ABSTRACT

The flat undersurface of the turntable is supported on three idler casters. The disc is driven on the periphery by a gear motor which has a drive wheel attached. The direction of rotation of the turntable can be reversed by changing the direction of the motor electrically and by moving the position of the motor so that it tends to drive into the disc as it turns thereby increasing the wheel pressure and friction as the load increases. A spring biases the drive wheel towards this position so that when the power is turned off the motor and gear train acts as a brake. A pair of guide wheels act with the drive wheel to center the turntable. The motor speed is controlled by changing the resistance of a potentiometer on a variable speed motor controller. The potentiometer is converted from a circular motion to a linear motion by a capstan and cable arrangement. A slide moves, when pulled by the stock. The slide pulls a cable that is wrapped around a capstan which is attached to the speed control potentiometer. The cable is pinned to the capstan and is weighted at the other end to provide a constant tension but variable speed supply of stock.

17 Claims, 6 Drawing Sheets

TURNTABLE FOR MOTORIZED DELIVERY OF COILED STOCK

TECHNICAL FIELD

The invention relates to a turntable for the motorized delivery of coiled stock, such as, steel, aluminium, or plastic sheet to stamping or other forming machines. It could also be called a pallet decoiler.

BACKGROUND ART

Such turntables are known in the prior art; however, they have several disadvantages. One is, it is difficult to mount them for concentric rotation which is free from added friction due to spindles, rubbing against guides, and the like. Another is, that when they are driven by a wheel against a peripheral flange, reversing the direction of the drive causes the wheel to tend to disengage from the flange rather than engage the flange. A further disadvantage of prior art turntables is that they do not deliver the stock at constant tension or provide a fly wheel effect, as their speed control devices use springs, pendulums, or the like.

DISCLOSURE OF THE INVENTION

According to my invention, a round top panel or disc comprising the turntable is supported by three casters; a pair of guide wheels engage the flange. A motor and drive wheel is mounted to a arm that pivots beyond the center of the disc that it drives. It can have two positions depending on the direction of rotation of the disc. These positions are chosen to correspond to the opposite directions of rotation of the disc, such that when the drive wheel engages the flange, it tends to be driven into the flange increasing the force between them. The drive wheel is preferably biased in this position by a spring, which when the power is cut off causes the drive wheel gear train and motor to act like a rotating brake band against the disc. The stock is supplied at constant tension by winding it around a drum so that the drum is pulled by the material being pulled into a stamping or other forming machine. The drum is attached to a slide and a cable is attached to the slide and wound around a capstan. The cable is secured to the capstan at one point with a pin. The cable then goes to a weight which biases the slide. The capstan is attached through gears to a potentiometer. The potentiometer controls the speed of a motor. In the off position, when the slide is fully retracted the motor does not run.

As the slide is pulled outward, the motor turns on and the speed of the motor increases proportionally to the slide position rotating the disc top and feeding material to the machine. A switch is provided which is actuated to turn off the motor when the drum and slide reaches its fully extended position.

Preferably, two cables are provided; one connected to each side of the slide, each equally weighted, such that the drum is gently guided towards a vertical neutral position.

OBJECTS OF THE INVENTION

It is therefore an object of the invention to provide an improved turntable for motorized delivery of coiled stock.

Another object of the invention is to provide such a turntable employing little friction and which is self-centering.

A further object of the invention is to provide such a turntable having drive means, which works equally as well driving the turntable in either direction.

A still further object of the invention is to provide such a turntable in which the drive means acts as a brake when the drive means is shut off.

Still another object of the invention is to provide a constant tension controller for the turntable drive means.

Other objects of the invention will in part be obvious and will in part appear hereinafter. The invention accordingly comprises the features of construction, elements and arrangements of parts, which will be exemplified in the construction hereinafter described. The scope of the invention is indicated in the claims.

BRIEF DESCRIPTION OF THE DRAWINGS

For fuller understanding of the nature and objects of the invention, reference should be had to the following detailed description, taken in connection with the accompanied drawings, in which.

The same reference characters refer to the same elements throughout the several views of the drawings.

BEST MODE FOR CARRYING OUT THE INVENTION

Figure 1:
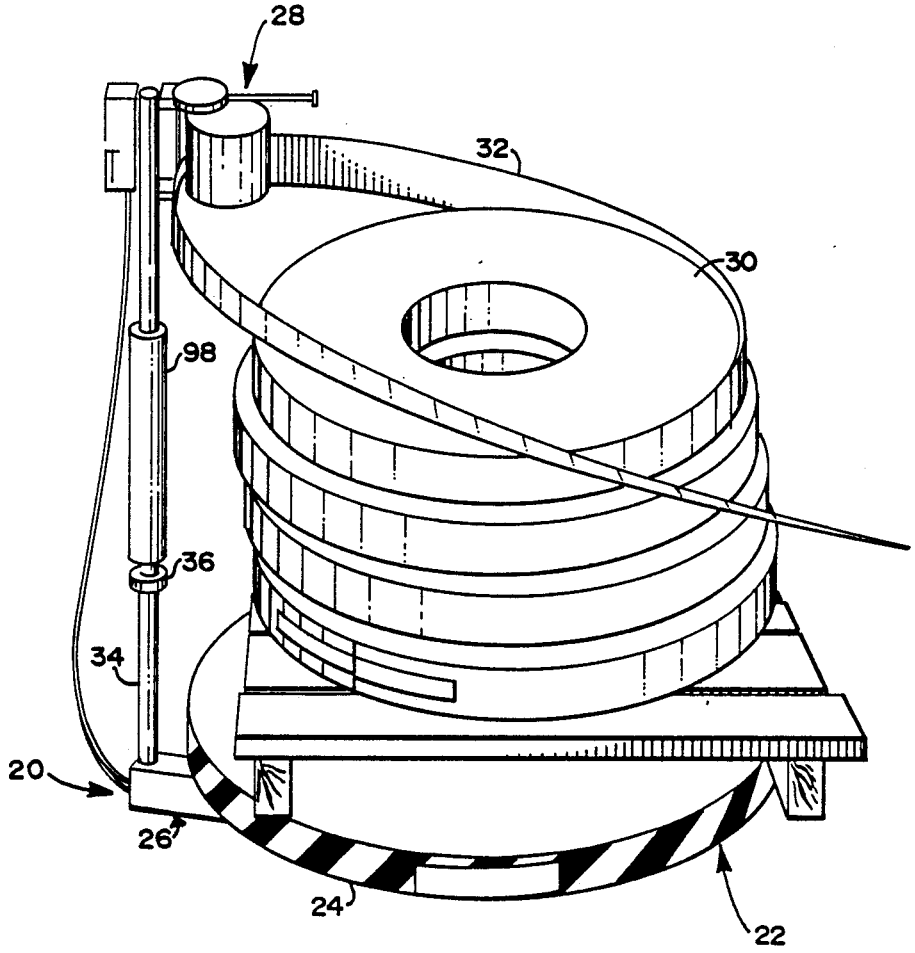
FIG. 1 is a vertical perspective view of a turntable according to the invention having coiled stock mounted thereon.

Referring to FIG. 1, a turntable according to the invention is generally indicated at 20. It comprises a top pan or disc generally indicated at 22 having a depending right circular cylindrical flange 24 supported on a support frame generally indicated at 26. Also mounted to support frame 26 is a constant tension motor control, generally indicated at 28. One or more coils of stock 30 are set upon the turntable 22 and the strip stock 32 fed around the control 28 and then to a punch or other forming machine (not shown). The control 28 may be adjusted vertically on post 34 and fixed by means of set screw 36.

Figure 2:
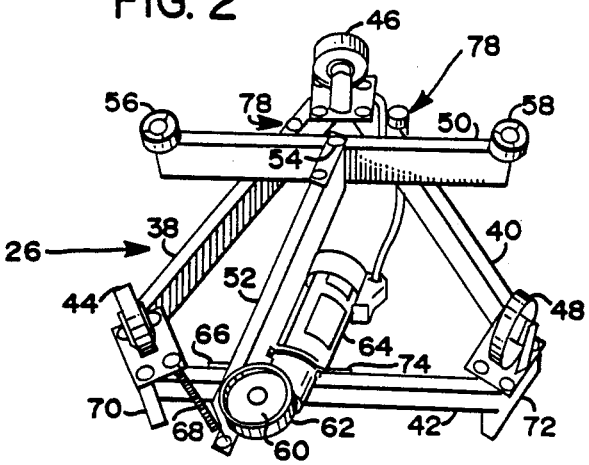
FIG. 2 is a top perspective view of the turntable support and drive mechanism with the turntable removed.

Now referring to FIG. 2, the support frame 26 comprises three beams 38, 40 and 42 formed into a triangular frame. Three casters, 44, 46 and 48 are mounted to the frame 26 and support the circular flat under surface of the pan 22 (FIG. 1) for free rotation thereof. A cross beam 50 is mounted to beams 38 and 40. A pivotable arm 52 is pivoted to beam 50 at pivot pin 54. Guide wheels 56 and 58 are mounted to each end of beam 50 and are adapted to engage the inner side of the peripheral flange 24 (FIG. 1).

At the end of pivotal arm 52, there is a drive wheel 60 preferably having a elastomeric outer surface 62 for engaging and driving the peripheral flange 24 so that its path is defined as circular by the drive wheel 60 and the guide wheels 56 and 58.

Drive wheel 60 is driven by a ½ horse power 90 volt DC totally enclosed fan cooled motor Number WD7002 and a gear box 13GED20R56C, both available from Morse Industrial Corporation. Other similar speed controlled drive means can be employed.

Figure 3:
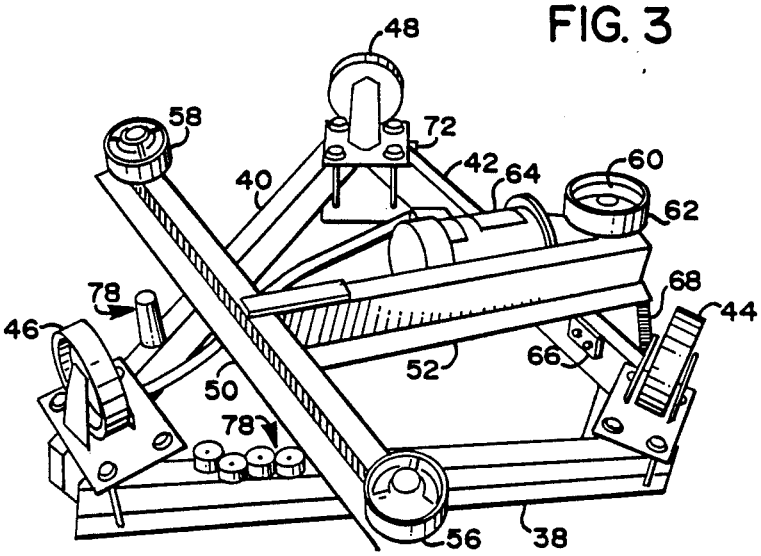
FIG. 3 is another perspective view similar to FIG. 2.
Figure 4:
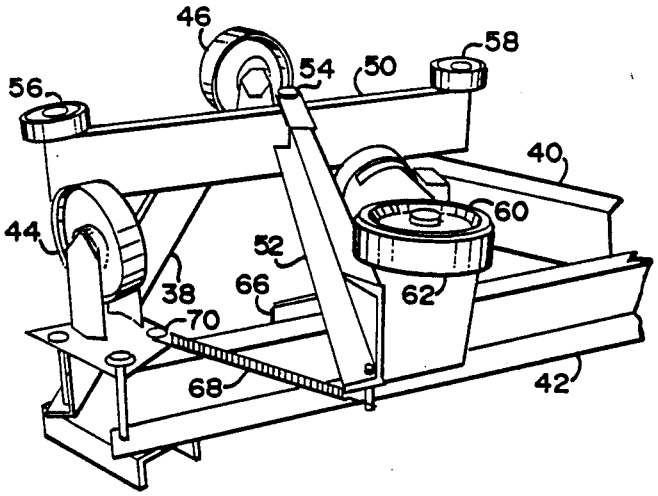
FIG. 4 is a fragmentary perspective view of the motor drive and spring arrangement of the invention.

As best seen in FIGS. 3 and 4, pivot arm 52 is pulled towards a stop 66 by means of a spring 68 for driving the pan in one direction; namely, counterclockwise as seen from the top.

To drive the pan in the opposite direction, that is clockwise as seen from the top, the spring 68 is disengaged from pin 70 (best seen in FIG. 4) and engaged with pin 72 (best seen in FIG. 3) and the pivot arm 52 is pivoted over toward the opposite stop 74 (see FIG. 2).

The small weights 78 shown in FIG. 3 are utilized in the speed controller as explained below.

Figure 5:
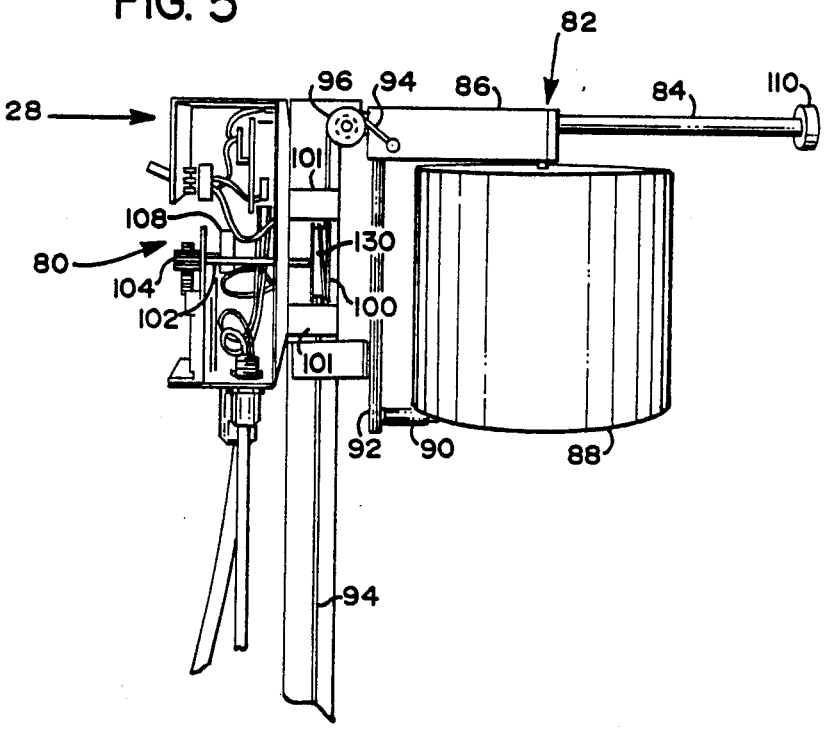
FIG. 5 is a vertical view of the constant tension speed controller according to the invention.
Figure 6:
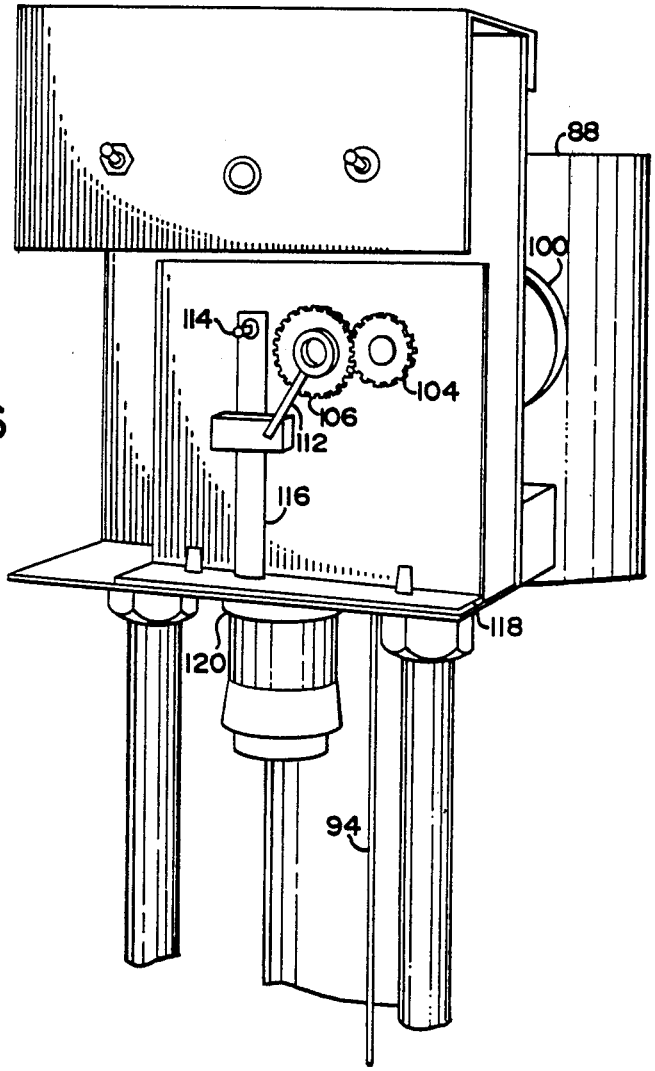
FIG. 6 is a vertical view taken from the left side of FIG. 5.

Now referring to FIGS. 5 and 6, the speed controller, generally indicated at 28, comprises a motor control box, generally indicated at 80, and a stock guide, generally indicated at 82.

The guide 82 comprises a horizontal rod 84 having a slider 86 mounted thereon for free movement along and around rod 84. Depending from the slider 86 is a freely rotatable drum 88, horizontal guide 90 and vertical guide 92. As best seen in FIG. 1, the stock 32 is fed between the drum 88 and the guide 92. When the stock is pulled, the slider 86 tends to move out along the rod 84. Two cables 94, only one of which is shown, are mounted to opposite sides of slider 86. The cables pass over pulleys 96 and are attached at their bottom ends to weights, such as the weights 78 shown in FIG. 3 guided within vertical tubes 98 (see FIG. 1).

One of the cables fits over a capstan 100 and turns shaft 102 rotating gear 104. The capstan 100 may be provided with cable restraining guides 101. Specifically referring to FIG. 6, gear 104 drives another gear 106, engaged therewith to which a potentiometer indicated at 108 (FIG. 5) is attached which controls the speed of the motor 64. Thus, if the force exerted on the stock when it is pulled about drum 88 is greater than the total weights on the cables 94, the slider 86 will move outwardly and the turntable will speed up until the force pulling the stock equals the force provided by the weights on the cables 94. Thus, the speed of the turntable may vary, but the stock will be supplied at a constant tension.

Only one cable 94 is required for the control function, but by using a pair of cables on either side of the slider 86, the cables tend to restore it to a normal vertical position.

Often the ends of the stock when the entire coil is unwound, has a flange thereon which will engage drum 88 and pull slider 86 all the way to a stop 110 mounted at the end of rod 84 (see FIG. 5). Before this happens, referring to FIG. 6, gear 106 will turn counterclockwise until pin 112 mounted thereon engages and throws toggle 114 of a toggle switch turning off the motor drive. The toggle switch also has mounted thereto a vertical rod 116 passing through the bottom of the motor control case 118 and forming a reset button 120.

Figure 7:
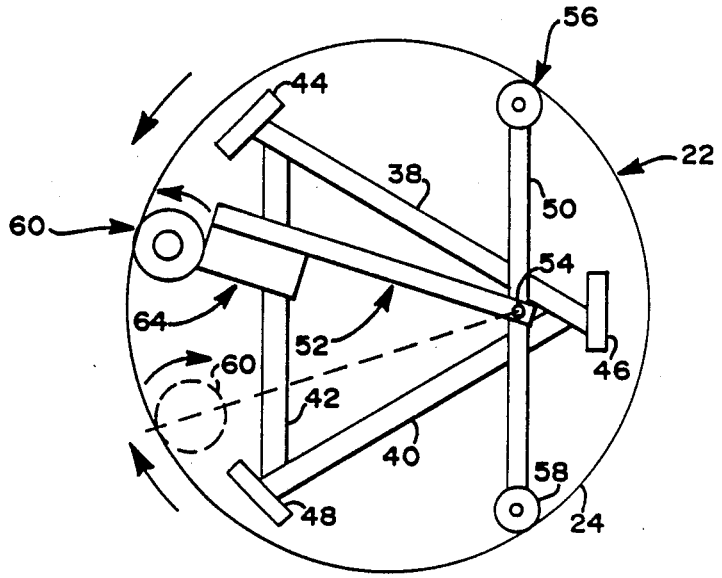
FIG. 7 is a sketch illustrating a principal of the invention.

Summarizing some of the principal features of the invention and referring to FIG. 7, as seen from above, the round top pan or disc is supported by three casters 44, 46 and 48. The disc is driven on the periphery by gears and motor 64 which has a drive wheel 60 attached. The direction of the disc can be reversed by changing the direction of the motor electrically and by moving the position of the motor so it tends to drive into the disc as it turns thereby increasing the wheel pressure and friction as the load increases.

Figure 8:
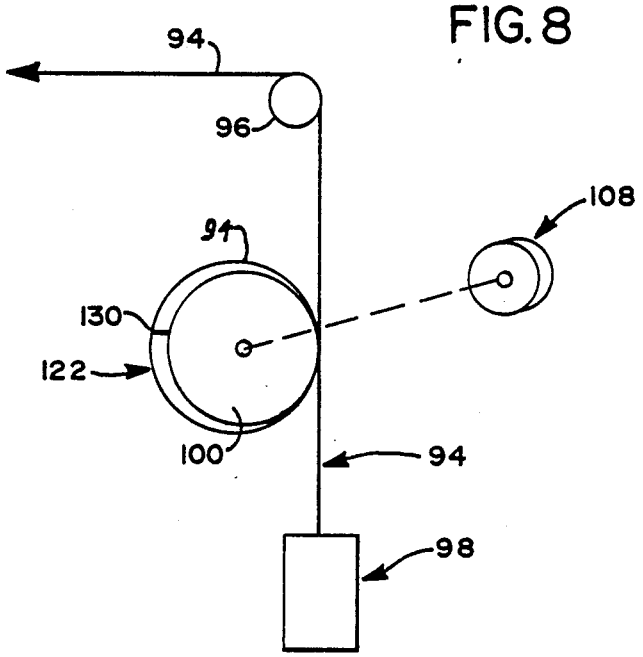
FIG. 8 is a sketch illustrating a principal of the invention.

Referring to FIG. 8, the motor speed is controlled by changing the resistance of a potentiometer 108 on a variable speed motor controller. The potentiometer 108 is converted from a circular motion to a linear motion by a capstan and cable arrangement generally indicated at 122. A slide moves, pulling a cable 94 that is wrapped around a capstan 100 which is attached to the speed control potentionmeter. The cable is pinned to the capstan at pin 130 so it does not change position.

Figure 9:
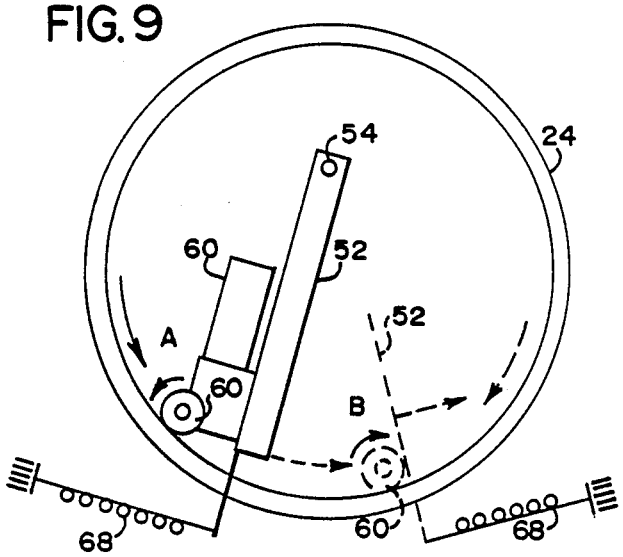
FIG. 9 is a sketch illustrating a principal of the invention.

Referring to FIG. 9, as seen from above, the motor 64 is mounted so that it pivots beyond the center of the disc that it drives. It can have two positions depending on the direction of the disc rotation. When the disc rotates counterclockwise, the motor is positioned in position A. The drive wheel 60 on the gear drive also rotates in the counterclockwise direction in this position. There is a spring 68 to hold the drive wheel 60 against the flange 24. When the motor 64 first starts, the drive wheel 60 tends to drive into the flange 24 and does not require the spring to maintain friction on the drive wheel. As the disc starts to rotate, it gains momentum. When the motor shuts off, the spring 68 and drive wheel 60 and gear box 64 act like a soft brake slowing the load down gently. The drive wheel 60 stops driving and is held like a rotating brake band against the flange 24 by the spring 68.

The motor gear drive assembly is positioned in position B in FIG. 9 for clockwise rotation of the top disc.

Those skilled in the art will understand that other means than arm 52 could be provided to move the drive wheel 60 from position A to position B such as mounting it and motor and gear assembly 60 on a rail between positions A and B.

Figure 10:
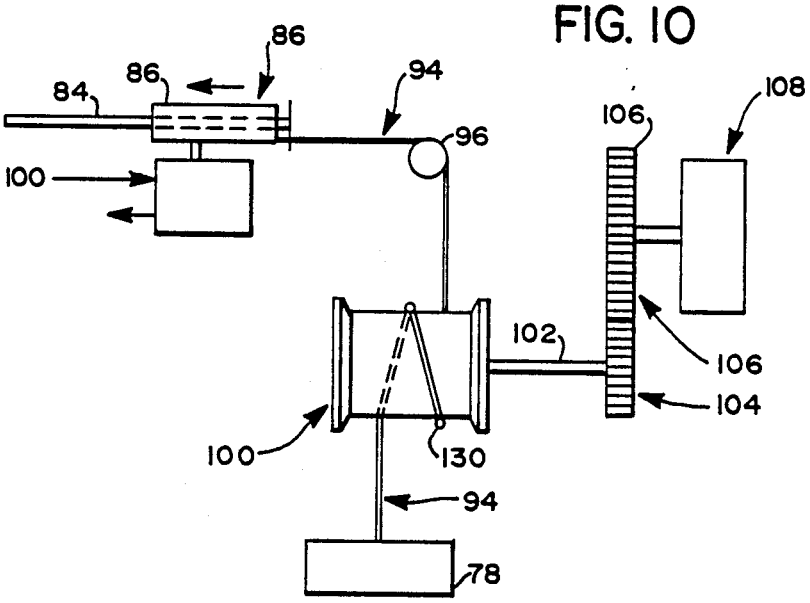
FIG. 10 is a sketch illustrating a principal of the invention.

Referring to FIG. 10, the drum 88 is pulled by material being fed into a machine. The drum 88 is attached to a slide 86. A cable 94 is attached to the slide and is wound around a capstan 100. The cable is secured to the capstan 100 at one point with a pin 130. The cable 94 then goes to a weight 78 which biases the slide 86. The capstan 100 is attached through gears 104, and 106 to a potentiometer 108. The potentiometer 108 controls the speed of a motor 64. In the off position, when the slide 86 is fully retracted the motor 64 does not run.

As the slide 86 is pulled outward, the motor 64 turns on and the speed of the motor increases proportionally to the slide position rotating the disc top 22 and feeding material to the machine. When the tension in the stock pulling the slide 86 equals the weight 78, the turntable runs at constant speed.

It will thus be seen that the objects set forth above, among those made apparent from the preceeding description, are efficently obtained and, since certain changes may be made in the above described construction without departing from the scope of the invention, it is intended that all matter contained in the above description, or shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desirous cured by Letters Patent is:

1. A turntable for motorized delivery of coiled stock comprising:

(A) a turntable comprising a right cylindrical flange;

(B) a support frame;

(C) means mounted to said frame for supporting said turntable for free rotation thereof;

(D) a pair of guide wheels mounted to said frame and adapted to engage said cylindrical flange; and, (E) a drive wheel mounted to engage said cylindrical flange at either of two positions for driving said turntable and for causing said guide wheels to engage said cylindrical flange.

2. A turntable as defined in claim 1 further comprising:

(F) spring means for biasing said drive wheel against said flange at a selectable one of said two positions depending on the direction of rotation of said turntable such that the action of said drive wheel against said flange increases the force of said drive wheel against said flange.

3. A turntable as defined in claim 2 further comprising:

(G) a variable speed electric motor and a set of reduction gears for driving said drive wheel.

4. A turntable as defined in claim 3 further comprising:

(H) control means for said electric motor for controlling the speed thereof such that said turntable rotates at speeds which will supply stock at constant tension at variable speeds on demand.

5. A turntable as defined in claim 1 further comprising:

(F) control means for said drive wheel controlling the speed thereof such that said turntable rotates at speeds which will supply stock at constant tension at variable speeds on demand.

6. A turntable as defined in claim 1 further comprising:

(F) stock control means adapted to engage said stock as it is pulled from a coil disposed on said turntable and movable in a direction towards that in which said stock is pulled when said stock is pulled;

(G) means for supplying a substantially constant tension to said control means; and (H) motor control means controlled by the position of said stock control means and adapted to cause said drive wheel to speed up said turntable when said stock control means moves in a direction towards that in which said stock is pulled.

7. A turntable as defined in claim 6 further defined in that said constant tension supplying means comprises a cable attached at one end to said stock control means and at the other to a weight free to move up and down.

8. A turntable as defined in claim 7 further comprising:

(I) a capstan about which said cable is wound; and (J) a motor speed controlling potentiometer driven by said capstan.

9. A turntable as defined in claim 8 further defined in that said cable is pinned to said capstan.

10. A turntable as defined in claim 8 and a motor cut off switch operated by said capstan when said weight is in its highest position.

11. A turntable as defined in claim 6 wherein said stock control means comprises;

(a) a horizontal slider, and (b) a rotatable drum mounted thereto.

12. A turntable as defined in claim 11 wherein said drum is free to move about the axis of said slider.

13. A turntable as defined in claim 12 further defined in that said constant tension supply means comprises a cable attached at one end to said stock control means and at the other to a weight free to move up and down.

14. A turntable for motorized delivery of coiled stock comprising:

(A) a turntable comprising a circular flat undersurface and a right cylindrical depending flange;

(B) a support frame;

(C) at least three support wheels mounted to said frame for supporting said turntable on said circular flat undersurface for free rotation thereof;

(D) a pair of guide wheels mounted to said frame and adapted to engage said cylindrical flange;

(E) an arm pivotally mounted to said frame at one end thereof; and (F) a drive wheel mounted to the other end of said arm adapted to swing through an arc to engage said depending flange at either of two positions for driving said turntable.

15. A turntable as defined in claim 14 further comprising:

(G) spring means for biasing said drive wheel against said flange at a selectable one of said two positions depending on the direction of rotation of said turntable such that the action of said drive wheel against said flange increases the force of said drive wheel against said flange.

16. A turntable as defined in claim 15 wherein the distance between said pivotal mounting of said arm and said drive wheel is greater than the radius of said circular flange.

17. A turntable as defined in claim 14 wherein the distance between said pivotal mounting of said arm and said drive wheel is greater than the radius of said circular flange.

* * * * *